United States Patent [19]

Saunders

[11] 4,208,642

[45] Jun. 17, 1980

[54] MODULAR MICROSTRIP TRANSMISSION LINE CIRCUITRY

[75] Inventor: Ronald J. Saunders, Santa Barbara, Calif.

[73] Assignee: Raytheon Company, Lexington, Mass.

[21] Appl. No.: 954,713

[22] Filed: Oct. 25, 1978

[51] Int. Cl.[2] ..... H01P 1/04; H01P 3/08

[52] U.S. Cl. ..... 333/246; 333/260

[58] Field of Search ..... 333/246, 260; 339/17 LM, 17 M; 361/395, 413, 414, 415

[56] References Cited

U.S. PATENT DOCUMENTS

| | | | |
|---|---|---|---|
| 3,218,584 | 11/1965 | Ayer | 333/246 |
| 3,792,383 | 2/1974 | Knappenberger | 333/205 |
| 4,143,342 | 3/1979 | Cain et al. | 333/246 X |

FOREIGN PATENT DOCUMENTS

| | | | |
|---|---|---|---|
| 1591586 | 12/1970 | Fed. Rep. of Germany | 333/246 |

OTHER PUBLICATIONS

Stuckert, *Transmission Line Connector,* IBM Tech. Disclosure Bulletin, vol. 8, No. 4, Sep. 1965.

Smith, *Interconnection Devices,* IBM Tech. Disclosure Bulletin, vol. 9, No. 2, Jul. 1966.

*Primary Examiner*—Paul L. Gensler

*Attorney, Agent, or Firm*—Richard M. Sharkansky; Joseph D. Pannone

[57] ABSTRACT

A modular microstrip transmission line circuit arrangement wherein each pair of modules includes: A microstrip circuit having a dielectric substrate with strip conductor circuitry formed on one side and a ground plane formed on the other side; and a support structure, the ground plane being affixed to a surface of the support structure. A portion of the ground plane of each module protrudes from an end of its support structure. A conductive gasket is disposed between the pair of modules beneath the protruding portions of the ground planes. A second resilient gasket is disposed between the conductive gasket and a base to force the conductive gasket against the protruding portions of the ground planes when the modules are fastened to the base, such conductive gasket providing a continuous ground plane between the pair of modules. A conductive strip is bonded to the ends of adjacent strip conductors to complete the electrical circuit between the pair of modules. With such an arrangement an individual module may be easily replaced from the base.

7 Claims, 3 Drawing Figures

MODULAR MICROSTRIP TRANSMISSION LINE CIRCUITRY

BACKGROUND OF THE INVENTION

This invention relates generally to microstrip transmission line circuitry and, more particularly, to modular microstrip transmission line circuitry.

As is known in the art, microwave transmission line systems using a plurality of electrically interconnected microstrip transmission line circuits have been used in a variety of applications. In such systems, the circuits are generally permanently bonded to the housing in which they function, and, hence, the replacement of any one of the circuits is relatively difficult. Further, in those systems where the circuits are removable it is generally difficult to provide proper ground plane continuity between interconnected circuits.

SUMMARY OF THE INVENTION

In accordance with the present invention, each pair of microstrip transmission line modules includes: A microstrip circuit having a dielectric substrate with strip conductor circuitry formed on one side thereof and a ground plane formed on the other side thereof; and a support structure, the ground plane being affixed to a surface of the support structure, a portion of such ground plane protruding from an edge of such support structure. A conductive gasket is disposed between the pair of modules beneath the protruding portions of the ground planes. Means are provided to force the conductive gasket against the protruding portions of the ground planes to provide a continuous ground plane between the pair of modules. A conductive strip is bonded to the ends of adjacent strip conductors.

The pair of modules may be installed in a base with conventional screws fastening the support structures to such base enabling easy removal of a module. The conductive gasket may be disposed on a resilient gasket which may be easily inserted, with the conductive gasket on top of it, under the protruding ground planes prior to tightening the screws. Once properly positioned beneath the protruding portions of the ground planes, the screws are tightened to both securely fasten the modules to the housing and securely force the conductive gasket up against the protruding portions of the ground plane.

BRIEF DESCRIPTION OF THE DRAWINGS

The foregoing features of this invention, as well as the invention itself, may be more fully understood from the following detailed description read together with the accompanying drawings, in which:

FIG. 3 is a plan view of a portion of the pair of microstrip transmission line modules shown in FIG. 1.

DESCRIPTION OF THE PREFERRED EMBODIMENT

Figure 1:
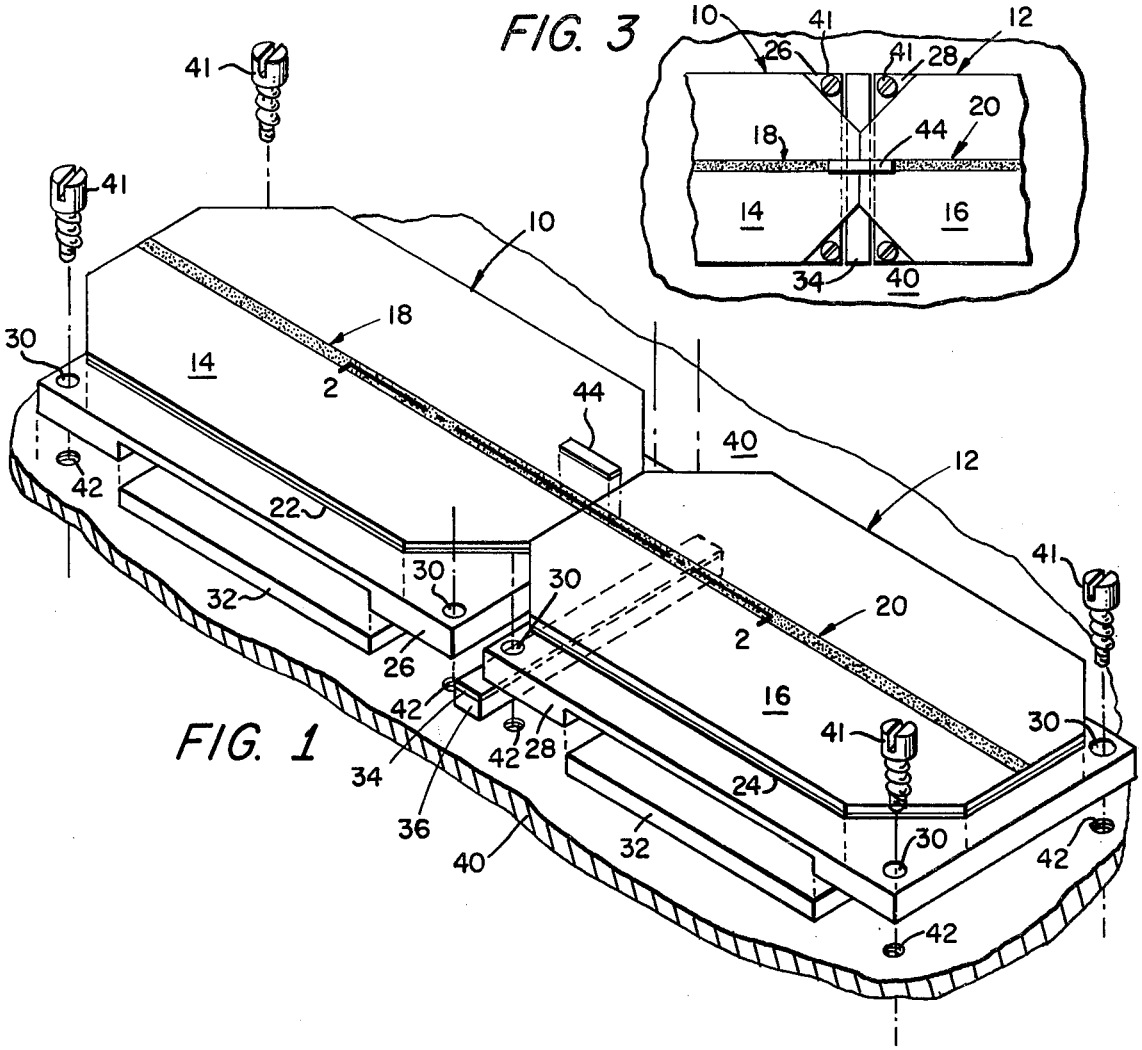
FIG. 1 is an isometric, exploded drawing of a pair of microstrip transmission line modules coupled together according to the invention.
Figure 2:
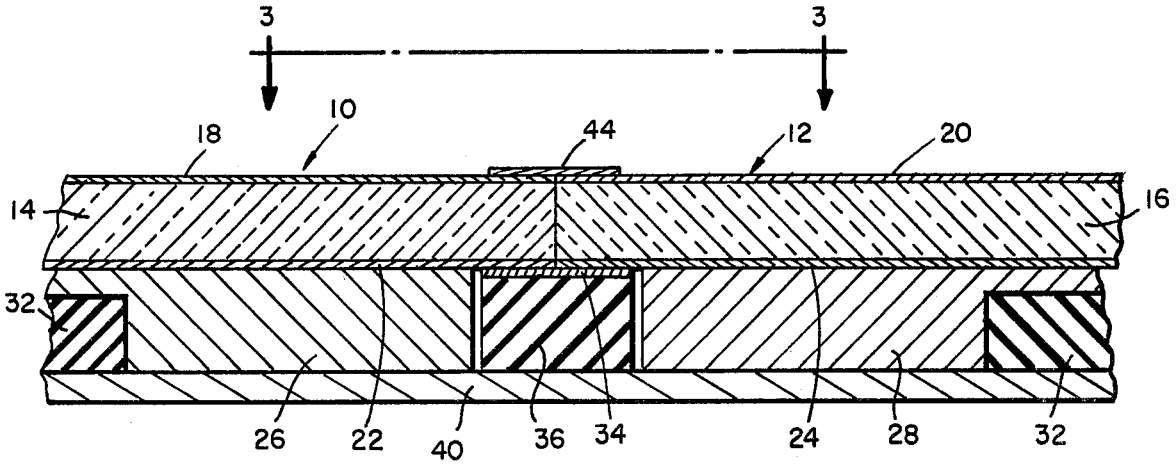
FIG. 2 is a cross-sectional view of the pair of coupled microstrip transmission line modules shown in FIG. 1, such cross-section being taken along line 2—2.

Referring now to FIGS. 1, 2 and 3, a pair of microstrip transmission line modules 10, 12 are shown. Each one of such modules 10, 12 includes a microstrip circuit having a dielectric substrate 14, 16 with microstrip transmission line strip conductor circuitry 18, 20 formed on the upper surfaces of such substrates 14, 16, respectively, using any conventional photlithographic chemical etching process and conductive ground planes 22, 24 formed on the opposite surfaces of such substrates 14, 16, respectively. Here the dielectric substrates 14, 16 are alumina ceramic material and the strip conductor circuitry 18, 20 and ground planes 22, 24 are gold. Here the microstrip circuits are 50 ohm transmission lines.

The microstrip circuits are affixed to support structures 26, 28, here stainless steel, as shown, here by fastening the ground planes 22, 24 to the upper surfaces of the support structures 26, 28 using a conductive epoxy. The support structures 26, 28 are preferably fabricated of materials which have a similar thermal expansion to the substrates 14, 16. It is noted that a portion of each microstrip circuit, i.e., a portion of the substrates 14, 16, strip conductor circuitry 18, 20, and ground planes 22, 24 protrude from an edge, here the shorter edge, of the support structures 26, 28, as shown, for reasons to become apparent hereinafter. It is also noted that each one of the support structures 26, 28 have four holes 30 machined through four corners of the support structure, as shown. The bottom sides of the support structures 26, 28 are notched as shown to enable a suitable radio frequency absorber 32 to be compactly positioned and affixed to such bottom sides, as shown, using any conventional nonconductive epoxy.

A conductive gasket or conductive elastomer 34, here EMI/RFI pressure seal strip gasketing manufactured by Cal-Metex Corp., 20437 Western Avenue, Torrance, Calif. 90501, is affixed, here by a suitable epoxy, to a resilient gasket 36, here made of rubber. The gasket 34 forms a ground plane for the structure. The gasket 34 and gasket 36 are inserted between the pair of modules 10, 12 beneath the portions of the ground planes 22, 24 which protrude from the edges of the support structures 26, 28. The modules 10, 12 and the gaskets 34, 36 are then placed on a base 40, as shown. The modules are then fastened to the base 40 by conventional spring-loaded screws 41 which pass through holes 30 into drilled and tapped holes 42 formed in the base 40. Once properly positioned beneath the protruding portions of the ground planes 22, 24, the screws are tightened to both securely fasten the modules 10, 12 to the base 40 and to compress the resilient gasket 36, thereby enabling such gasket 36 to force the conductive gasket 34 securely against the protruding portions of the ground planes 22, 24. When forced against the protruding portions of the ground planes 22, 24, such conductive gasket 34 provides a continuous ground plane between the microstrip circuits. It should be noted that preferably the holes 42 are designed such that the edges of the substrates 14, 16, strip conductors 18, 20 and ground planes 22, 24 abut as shown in FIG. 2. A conductive ribbon 44, here gold, is thermo-compression bonded to ends of the strip conductor circuitry 18, 20 as shown to complete the interconnections. Such ribbon 44 may be easily removed when it is desired to replace one of the modules 10, 12.

Having described a preferred embodiment of this invention, it is now evident that other embodiments incorporating these concepts may be used. For example, while a pair of modules has been described, the arrangement described herein may be used with many more interconnected modules. It is felt, therefore, that this invention should not be restricted to the disclosed embodiment, but rather should be limited only by the spirit and scope of the appended claims.

What is claimed is:

1. A modular microstrip transmission line circuit interconnect system, comprising:

(a) a base;

(b) a pair of microstrip circuits, each one having a dielectric substrate with strip conductor circuitry on one surface of such substrate and a ground plane on the opposite surface of such substrate;

(c) a pair of support structures, each one affixed to a corresponding one of the pairs of microstrip circuits, a portion of the ground plane of such affixed circuit protruding from an edge of such support structure, each one of such support structures being adapted to be removably attached to the base;

(d) means, including a resilient gasket, for forcing a conductor against the protruding portions of the ground planes of the pair of microstrip circuits, to provide a continuous ground plane between the pair of circuits, such resilient gasket being disposed between the base and the conductor; and (e) a conductive strip connected to ends of adjacent strip conductors.

2. An interconnect system, comprising:

(a) a base;

(b) a pair of microstrip circuits;

(c) a pair of support structures, each one being affixed to a ground plane of a corresponding one of the microstrip circuits, the ground plane of each circuit protruding from an edge of the support structure affixed thereto;

(d) a conductor disposed beneath the protruding ground planes; and (e) means, including a resilient gasket disposed between the conductor and the base, for forcing the conductor against the ground planes to provide a continuous ground plane between the pair of microstrip circuits.

3. The system recited in claim 2 including means for affixing the support structures to the base.

4. The system recited in claim 3 including an absorbing material affixed to the support structures.

5. A modular microstrip transmission line circuit interconnect system, comprising:

(a) a pair of modules, each one comprising:

(i) a dielectric substrate;

(ii) a strip conductor on one surface of the dielectric substrate;

(iii) a conductive support structure comprising: an upper ground plane portion disposed on an opposite surface of the substrate; and, a lower mounting portion, such upper ground plane portion protruding from an edge of the lower mounting portion;

(b) a base;

(c) means, including a resilient member having an upper conductive portion, such resilient member being disposed between the base and the protruding upper ground plane portions of the pair of conductive support structures, for forcing the upper conductive portion against the protruding upper ground plane portions to provide a continuous ground plane between the pair of modules; and (d) a conductive strip connected to ends of each one of the strip conductors.

6. The system recited in claim 5 including means for removably attaching the conductive support member to the base.

7. The system recited in claim 6 including an absorbing material affixed to the support structure.

* * * * *